United States Patent [19]

Gray

[11] 3,999,400

[45] Dec. 28, 1976

[54] ROTATING HEAT PIPE FOR AIR-CONDITIONING

[76] Inventor: Vernon H. Gray, 28517 W. Oakland Road, Bay Village, Ohio 44140

[22] Filed: Aug. 8, 1974

[21] Appl. No.: 495,876

Related U.S. Application Data

[62] Division of Ser. No. 53,898, July 10, 1970, Pat. No. 3,842,596.

[52] U.S. Cl. ..... 62/115; 62/499; 165/105; 165/86

[51] Int. Cl.[2] ..... F25B 1/00

[58] Field of Search ..... 165/105, 869; 62/499, 62/115

[56] References Cited

UNITED STATES PATENTS

| | | | |
|---|---|---|---|
| 2,330,121 | 9/1943 | Heintz | 165/104 X |
| 2,522,781 | 9/1950 | Exner | 62/499 |
| 2,743,384 | 4/1956 | Turner | 165/105 X |
| 2,813,698 | 11/1957 | Lincoln | 165/105 X |
| 3,619,539 | 11/1971 | Taylor | 219/469 X |

*Primary Examiner*—Albert W. Davis, Jr.
*Attorney, Agent, or Firm*—Bosworth, Sessions, & McCoy

[57] ABSTRACT

A unique rotary hermetic heat pipe is disclosed for transferring heat from an external source to an external heat sink. The heat pipe has a tapered condensing surface which is curved preferably to provide uniform pumping acceleration, the heat pipe being rotated at a velocity such that the component of centrifugal acceleration in an axial direction parallel to the tapered surface is greater than 1G and so that the condensing surface is kept relatively free of liquid at any attitude. The heat pipe may be incorporated in an air conditioning apparatus so that it projects through a small wall opening. In the preferred air conditioning apparatus, a hollow hermetic air impeller is provided which contains a liquefied gaseous refrigerant, such as freon, and means are provided for compressing the refrigerant in the evaporator region of the heat pipe.

9 Claims, 7 Drawing Figures

ROTATING HEAT PIPE FOR AIR-CONDITIONING

REFERENCE TO RELATED APPLICATION

This application is a division of my copending application Ser. No. 53,898, filed July 10, 1970, now U.S. Pat. No. 3,842,596 which is incorporated herein by reference.

BACKGROUND AND SUMMARY OF THE INVENTION

The present invention relates to rotating heat pipes and more particularly to air conditioning apparatus incorporating a rotary heat pipe for transferring heat from a heat source to a heat sink.

The term "heat pipe" as used herein refers to any device that transfers heat by means of evaporation and condensation of a fixed amount of fluid within a sealed cavity of any shape formed in the device. In the operation of a heat pipe, a quantity of liquid locates in the relatively hot region of the cavity (the "evaporator" region) where it absorbs heat from the cavity walls in that region causing it to evaporate. The vapor flows to the cooler region of the cavity where it gives off heat to the walls of the cavity in that region (the "condenser" region) and condenses into a relatively cool liquid. The condensed, cooled liquid is then returned to the hotter zone of the cavity to repeat the cycle.

In my invention, I provide the rotating body with an interior sealed cavity which has a certain diameter at the hotter (evaporator) end of the body tapering up to a slightly smaller diameter at the cooler (condenser) end as, for example, is shown in FIG. 1.

I locate a small inventory of liquid in the cavity and rotate the body at high speed. At high speed, the liquid inventory forms a uniform annulus at the evaporator end. Heat transferred through the evaporator portion of the body wall vaporizes some of the liquid and the vapor so formed flows toward the axis of rotation and axially toward the condenser end. Here the vapor condenses on the cooled walls and the liquid condensate is pumped back along the tapered cavity walls by the small component of centrifugal acceleration tangential or parallel to the taper of the wall (hereinafter sometimes referred to as "centrifugal pumping acceleration" or "CPA"). The speed at which I rotate the body is sufficiently great to produce a component of centrifugal acceleration in the condensate parallel to the tapered cavity wall which is in excess of 1G acceleration at essentially all points on the condenser walls, and often preferably many times greater.

Accordingly, I provide a self-contained, vapor cycle heat transfer device which returns the condensate from the condenser region to the evaporator region at a relatively high velocity even against gravity or in the absence of gravity, and which can provide heat transfer ability which is greatly improved over that of conventional heat pipes and the like.

My invention is particularly well suited to provide substantial heat transfer between two ends of rotating body having a relatively long axial dimension and a relatively small diameter, since I can generate fairly large return pumping acceleration along a very small angle slope.

The benefits of my invention are obtainable only in a vapor cycle or two-phase system, and only in such a system where the cool condensing surface is kept relatively free of liquid.

It should be noted that at horizontal attitude under the influence of gravity, the liquid in the evaporator forms a non-uniform annulus when centrifugal acceleration of the liquid just exceeds 1G. As centrifugal acceleration in the liquid approaches the relatively high levels required to produce centrifugal pumping acceleration in excess of 1G according to the present invention, the liquid annulus becomes highly uniform and the pressure of the liquid increases substantially. This provides highly efficient boiling and vaporization effects since it greatly increases the convection of vapor bubbles and liquid in the annulus, and also provides a smooth interface at relatively high heat fluxes. By contrast, when boiling occurs at 1G, the interface is distorted and turbulent and tends to disperse relatively large droplets into the vapor which reduces the heat transfer effectiveness of the system. Accordingly, a device constructed in accordance with the principles of my invention may accommodate relatively high levels of heating without causing undue surface turbulence.

Because of the tendency of centrifugal acceleration to increase convection, the denser, cooler liquid flows away from the axis and quickly displaces the less dense heated liquid near the hot evaporator wall which, in turn, flows rapidly toward the axis. This prompt movement from the evaporator wall to the interface enhances evaporation, suppresses boiling and improves the heat transport capabilities of the system as a whole.

The present invention involves use of the heat pipe in an air conditioning apparatus. The heat pipe is part of a unique air conditioner having a hollow shaft extending through a small hole in the building wall and having a rotating refrigerant compressor at the end of the shaft.

In each of the embodiments of the invention herein described, the condenser surface is preferably curved in axial cross section to provide uniform pumping acceleration.

In the embodiment of the invention claimed herein an air conditioning unit is provided comprising a tapered hollow heat pipe projecting through an opening in a building wall. The heat pipe contains an inventory of liquid including a reservoir in an evaporator region at the inside of the wall and has a condenser region at the outside of the wall. Means are provided for transferring heat from the heat pipe to the outside air to condense the vapors in the condenser region, and means are provided for compressing a gaseous refrigerant at the outer surface of the heat pipe in the evaporator region. A hollow air impeller is preferably provided to receive the refrigerant and to rotate in unison with the heat pipe.

While many of the drawings are schematic and not exactly to scale, the relative dimensions of the heat pipe may be as shown.

DETAILED DESCRIPTION

Figure 1:
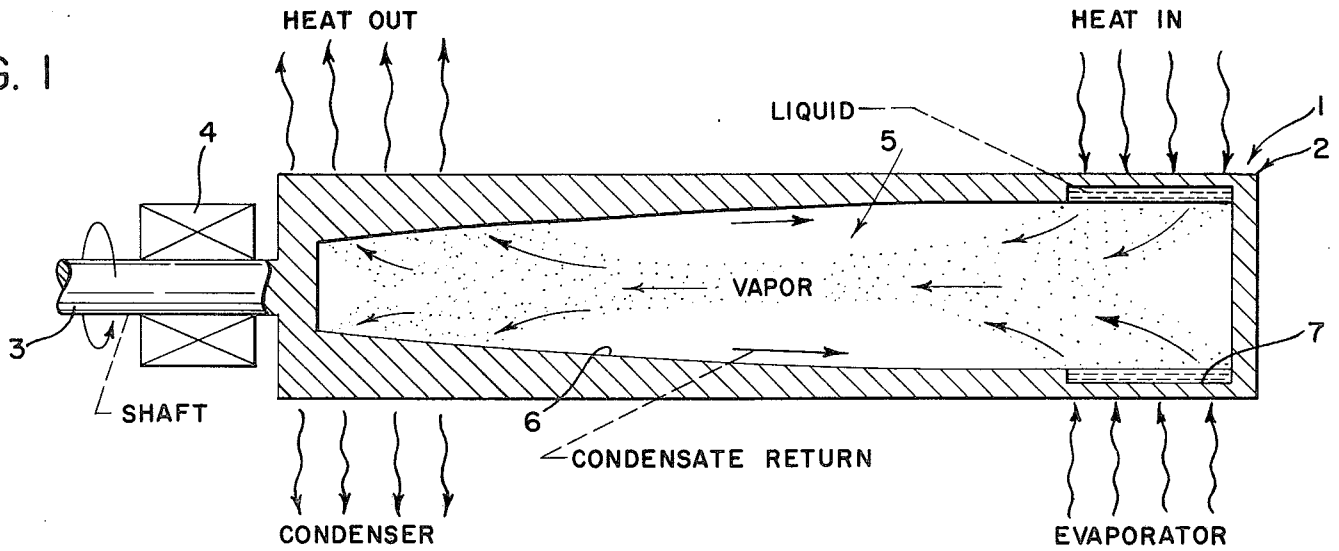
FIG. 1 is a longitudinal sectional schematic view of a rotating heat pipe constructed in accordance with the principles of the present invention.

Referring to the drawings in greater detail, FIG. 1 is a schematic view showing a centrifugal pumping heat pipe 1 constructed in accordance with the principles of the present invention. The heat pipe 1 has a generally cylindrical body portion 2 with an axial shaft 3 extending from one end. The shaft 3 is journalled for rotation in a bearing 4. An elongated cavity 5 is formed coaxially in the body portion 2. The cavity is generally frusto-conical with curved or substantially parabolic side walls 6. At the large end of the cavity, there is a cylindrical reservoir 7 which has a slightly larger diameter than the large diameter of the frustum. A small inventory of liquid is sealed in the cavity. The amount of liquid employed is such that when the pipe is rotated during operation, the liquid forms a uniform annulus which fills the reservoir 7 but does not overflow onto the parabolic walls 6. The amount of liquid may be less than the amount required to fill the reservoir 7 completely, but should be great enough that the reservoir 7 does not boil dry during operation.

In operation, the end of the pipe 1 wherein the reservoir 7 is located (the "evaporator" end) is subjected to heat which causes the liquid in the reservoir to vaporize. The vapor tends to fill the central empty space in the cavity. The opposed end of the pipe (the "condenser" end) is subjected to relatively cooler temperatures so that when the vapor encounters the walls 6 in the condenser end, it condenses. The pipe is rotating at a very high rate so that the condensate which forms on the walls 6 will be subjected to a radial or centrifugal acceleration which is great enough that the component of that acceleration parallel to the wall 6 at any point on the wall (the CPA) will be in excess of 1G.

Figure 3:
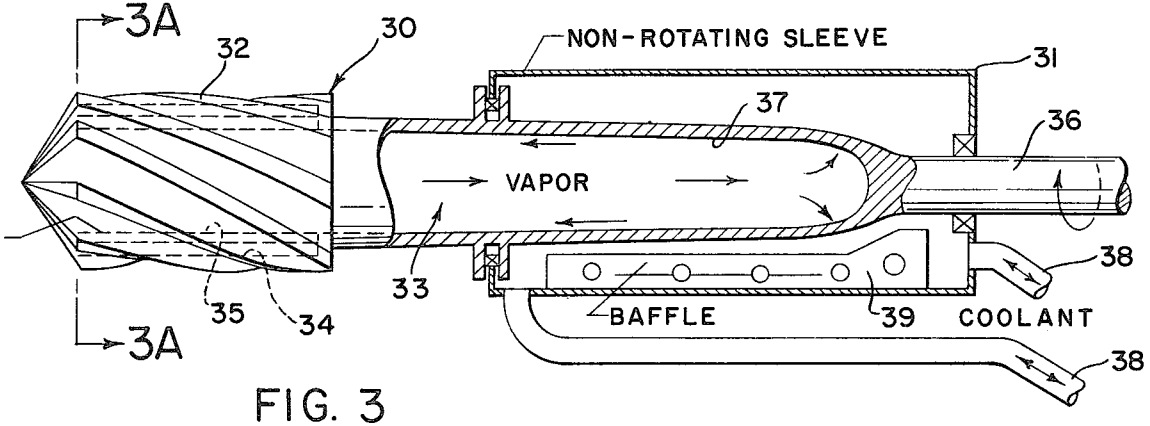
FIG. 3 is a longitudinal sectional schematic view of a drill bit assembly constructed according to the invention.
Figure 5:
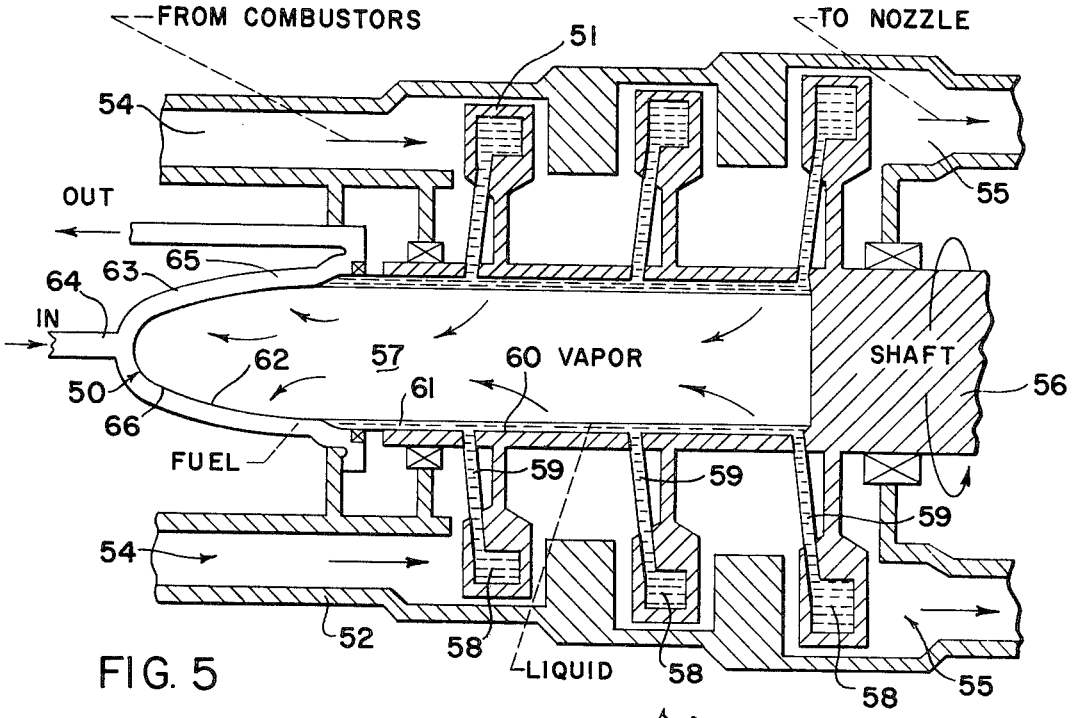
FIG. 5 is a longitudinal sectional schematic view of a turbine engine constructed according to the invention.

The CPA or centrifugal pumping acceleration of a body at a point on a sloped wall in a direction parallel to the wall at that point is equivalent to $\omega^2 r \sin\theta$, where $\omega$ = the angular velocity of the body, $\theta$ = the angle of a tangent to the surface of the wall at that point relative to the axis, and $r$ = the distance from the axis. It will be seen that certrifugal acceleration tends to increase as $r$ increases, so that the slope of the wall may be decreased as $r$ increases without decreasing the tangential component of centrifugal acceleration. For this reason, in each embodiment of the invention shown herein, the walls in the condenser portion of the cavity are preferably curved as shown in FIG. 1, FIG. 3 or FIG. 5.

In most applications of the present invention, the outer diameter of the rotating body will be limited as, for example, in the case of a drill for drilling a hole of a particular size. For this and other reasons, it will be desirable to determine what cavity wall curvature will produce the optimum pumping acceleration. In the usual case, this will be where the net pumping acceleration is relatively uniform at all points on the slope.

Accordingly, I have calculated the relationship of the radius, surface taper, and angular velocity to one another when it is desired to obtain a uniform centrifugal pumping acceleration at all points on the slope. In these calculations, it is necessary to take into account both the presence (or absence) of actual gravity and the attitude of the axis of the rotating body to the direction of actual gravity. The general equation is as follows:

$$r = 0.816\ (n + M \cos\theta \cos\beta)/(\text{rev./sec.})^2(\sin\theta)$$

where

- $r$ = the distance of the wall from the axis, expressed in feet;
- $n$ = the no. of G's desired for net pumping (including the effect of actual gravity);
- $m$ = the acceleration of actual gravity in G's, ($m$ = 0 in outer space, $m$ = 1 on earth);
- $\theta$ = the angle formed by the axis of rotation and a straight line drawing parallel to the surface of the wall at a particular point on the wall; and
- $\beta$ = the angle of the axis of rotation relative to the direction of actual gravity, where $\beta = 180°$ when the axis of rotation is vertical with the evaporator end down. $0° \leq \beta \leq 180°$.

The general equation assumes that the body is rotating at a rate sufficient to produce a centrifugal acceleration normal to the axis which is much greater than the actual ambient gravity.

I have also calculated the following simplified equations for special cases:

CASE I

Axis of rotation vertical, condenser end down, actual gravity = 1G. $r = 0.816(n + \cos\theta)/(\text{rev./sec.})^2(\sin\theta)$, ft.

CASE II

Axis of rotation vertical, condenser end up, actual gravity = 1G. $r = 0.816(n - \cos\theta)/(\text{rev./sec.})^2(\sin.\ \theta)$, ft. This equation is meaningless where $n < 1$.

CASE III

Axis of rotation horizontal, actual gravity between 0 and 1G; also axis at any angle with actual gravity = 0. $r = 0.816(n)/(\text{rev./sec.})^2(\sin\theta)$, ft.

From the above four equations, it is possible to generate ideal curves for the wall of the heat pipe. Very good approximate curves may be drawn by beginning at either end of the condenser wall and plotting values for $r$ and $\theta$ at small regular increments along axis of the pipe ($\Delta$ L). This generates a stepped slope which can be smoothed out by drawing a curve through the intersection of the taper and the radius for each value of $\Delta$ L. If desired, more accurate slopes can be generated from the above formulae by iteration.

In generating approximate curves for small taper portions of the wall (i.e., where $\theta < 6°$), one may assume that $\sin\theta = \tan\theta$. Accordingly, the following equations may be employed.

IN CASE I $$\tan\theta = 0.816(n+1)/r(\text{rev./sec.})^2$$

IN CASE III $$n = 1,\ \tan\theta = 0.816/r(\text{rev./sec.})^2$$

Since $\tan\theta = \Delta r/\Delta L$, one may generate the curve by determining the value of $\theta$ and $r$ for the wall at one point on the axis and then plotting subsequent points on the wall by inserting values for $\Delta L$ and solving for the corresponding values of $\Delta r$.

The curved condensing surface of the heat pipe is important in the drill, electric motor, gas turbine and air conditioner shown herein by way of example and in other applications as disclosed in said U.S. application Ser. No. 53,898. This is explained in more detail in NASA Contractor Report CR-130373 dated September 1973 and entitled "An Analytical and Experimental Investigation of Rotating Noncapillary Heat Pipes."

In the evaporator end, it is important to maintain heat flux below levels where critical nucleate boiling ("burn-out") occurs. This critical level tends to increase at high accelerations. For example, water boiled at 400G's and 815,000 BTU/hour, $ft^2$ is below the burn-out level, yet this heat flux is approximately double the normal critical value at 1G. Generally speaking, burn-out heat flux varies with the one-fourth power of acceleration in excess of 1G, and at multiple G levels, it is necessary to produce high levels of radial centrifugal acceleration on the wall and in the evaporator (since centrifugal pumping acceleration at any point on the taper is equal to centrifugal acceleration at that point times the sine of the slope angle at that point, and since the slope angle is typically quite small). Accordingly, the high levels of acceleration produced in the evaporator tend to raise the heat flux capacity of the evaporator.

For example, in a 2-inch diameter evaporator cylinder turning at about 6000 revolutions per minute, the centrifugal acceleration of the liquid is about 1000G's. The heat flux capacity of this evaporator with water is about 1,800,000 BTU/hour, $ft^2$. This is about 10 times greater than the highest capillary heat pipe heat flux reported prior to this invention.

At the condenser end, it is important to pump the condensate off the walls and back to the evaporator since any buildup of condensate reduces the condensing effectiveness of the walls. For this reason, it is preferable to produce relatively high levels of centrifugal pumping acceleration in the practice of my invention. Since, typically, centrifugal pumping acceleration equivalent to dozens of G's can be produced in devices constructed according to my invention, such devices can operate with much less thermal resistance in the condensate layer than devices with equivalent vertical condensing surfaces at 1G.

The thermal resistance of the condensate layer can be reduced still further by plating the condenser walls with noble metals.

Figure 2:
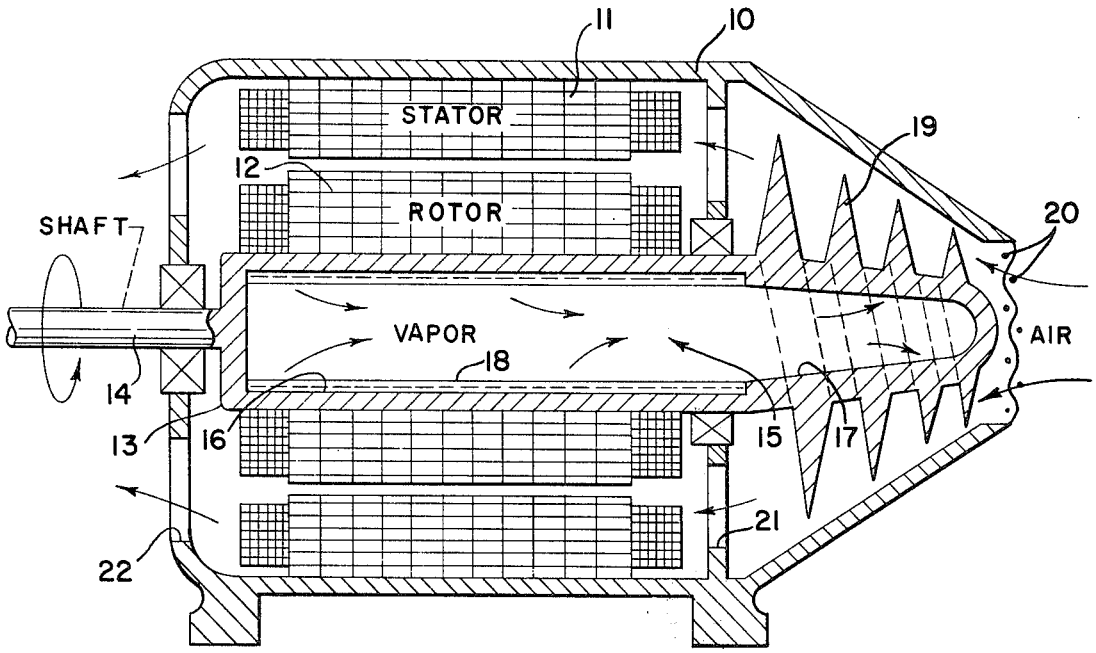
FIG. 2 is a longitudinal sectional schematic view of an electric motor according to the invention.

Turning to FIG. 2 of the drawings, there is shown a schematic drawing of an electric motor constructed in accordance with the principle of the present invention. The motor has a housing 10, a stator 11, and a rotor 12. The rotor core 13 has an axial drive shaft 14 extending from one end, and an auger-like portion 19 extending from the other end which serves as a fluid pump. The rotor core is further provided with a coaxial sealed cavity 15, which has cylindrical walls 16 adjacent the rotor windings (defining the evaporator region) and tapered walls 17 adjacent the auger portion 19 (defining the condenser region). The cylindrical walls 16 in the evaporator region have a slightly larger diameter than the largest diameter of the condenser walls 17 so that the evaporator walls are recessed to form a well-defined reservoir for the liquid 18. the rotor is shown rotating at a speed sufficient to form a substantially uniform liquid annulus in the reservoir. The liquid inventory is small enough that it does not overflow the reservoir to cover any appreciable portion of the condenser walls 17 during operation.

The importance of minimizing the amount of liquid on the condenser walls of devices constructed according to my invention has been discussed and, for this reason, a recessed, well-defined reservoir is preferred in this and most other embodiments of my invention as will be readily apparent to persons or ordinary skill in the art.

In the operation of the electric motor shown in FIG. 2, the rotor 12 develops localized heat in the rotor windings and at the bearings upon which the rotor is journalled in the housing 10. The heat is conducted through the cylindrical walls 16 of the core 13, where it is transferred to the liquid 18 in the reservoir. The liquid 18 is vaporized and the vapor flows radially toward the axis and axially to the condenser end where it condenses on the tapered walls 17. This condensate is subjected to centrifugal pumping acceleration to return it to the reservoir. When the vapor condenses on the walls 17, it gives off heat which is conducted through the walls 17 and into the auger blades 19. The motion of the auger blades 19 in the ambient air (entering the housing through an air inlet screen 20) enhances cooling of the condenser walls 17. Moreover, the auger 19 acts as a blower, forcing air through apertures 21, across the rotor and stator windings, and out the opposite side of the housing 10 via vents 22. This assists cooling of both the rotor 12 and stator 11.

Figure 3A:
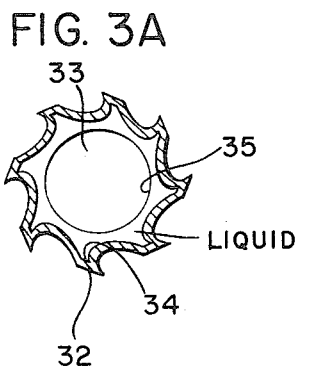
FIG. 3A is a transverse section taken along line 3A-3A of FIG. 3.

FIGS. 3 and 3A provide schematic illustrations of a drill bit assembly constructed in accordance with the principles of the present invention. The assembly consists essentially of a drill bit 30 and a non-rotating sleeve 31. The bit 30 has conventional helical cutting blades 32 formed at one end and is provided with a coaxial sealed cavity 33 with a length many times its diameter. The cavity has an enlarged reservoir portion adjacent the blades 32. The reservoir is defined by the cavity walls 34 which extend into the cutting blades 32. Liquid inventory 35 locates in the reservoir during rotation to form a substantially uniform annulus during operation, as shown. The cavity 33 tapers gradually from the reservoir to a smaller diameter at the opposite end. In operation, localized heat buildup in the evaporator region at the blades 32 is transferred away according to principles already discussed, as will be apparent. In addition, the sleeve 31 enhances heat transfer by flowing coolant (from the pipes 38) over the outer surface of the shank of the bit 36 and adjacent the condenser walls 37. Rotational flow in the coolant is minimized by locating one or more apertured baffles 39 on the inner surface of the sleeve 31.

Figure 4:
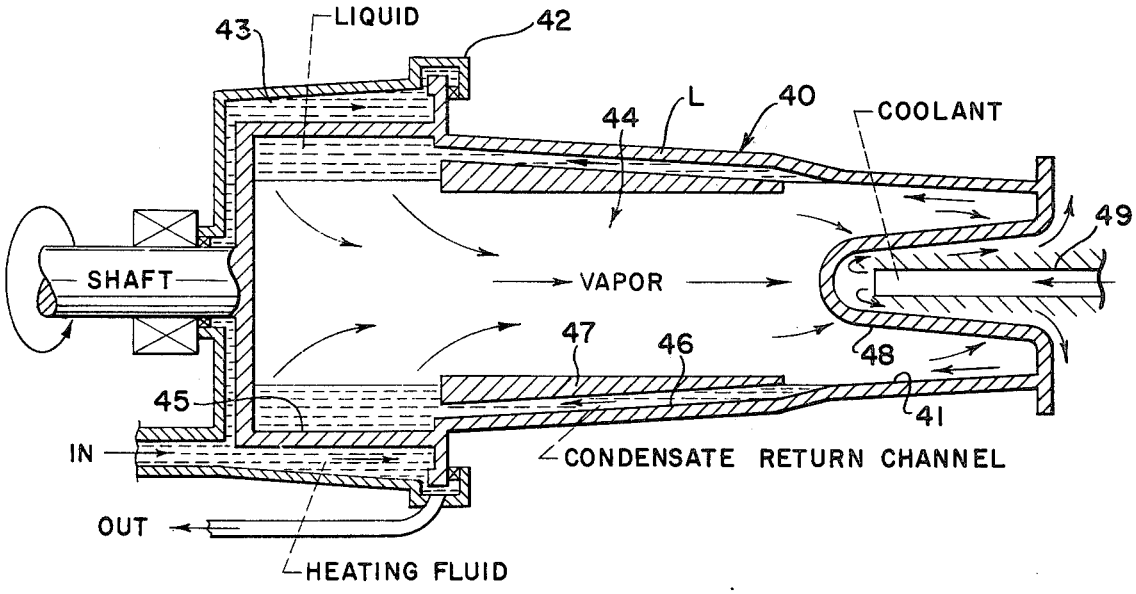
FIG. 4 is a longitudinal sectional schematic view of an alternate rotating heat pipe construction according to the invention.

FIG. 4 of the drawings shows a schematic representation of an alternate form of heat pipe 40 embodying features which may be employed together or singly in the embodiments of FIGS. 1 through 6 or other specific applications as desired. As shown, the pipe 40 is being employed to transfer heat away from a fluid 43 supplied to the evaporator end of the pipe in a non-rotating jacket 42. The pipe 40 is provided with coaxial sealed cavity 44 having a cylindrical evaporator wall 45 at the evaporator end, a conically tapered condenser wall 41 at the condenser end, and circumferentially spaced, generally axial submerged channels 46 extending between the evaporator wall 45 and the condenser wall 41 beneath a conically tapered wall 47 mounted in the pipe on radially outwardly extending posts or ribs (not shown).

The submerged passages 46 and conical wall 47 are provided between the condenser and evaporator regions because, in the central regions of a heat pipe, there is usually an adiabatic zone in which the vapor and liquid flows are transferred countercurrently. This is a zone of annular flow with the vapor at the center moving at much higher velocities than the liquid along the wall which creates the possibility that the vapor will blow the returning condensate film into waves or mist.

To solve this problem, if it occurs, one may employ submerged condensate passages as shown at 46 in FIG. 4.

A further feature illustrated in FIG. 4 of the drawings is that the transverse end of the condenser region is folded inwardly to accomplish one or more of several objectives, as follows: (a) to increase the area available for cooling when overall length is limited; (b) to increase the condensing heat-transfer coefficient by causing the condensate, as soon as it is formed, to be centrifuged off the convex inner surface 48 of the infolded wall and collect on the larger diameter tapered surface 41 for centrifugal pumping back to the evaporator region; and (c) to provide a concave outer surface opposite convex inner condensing surface 48, in which coolant is directed as a jet from a pipe 49 against the concave surface which, because of its shape, causes the coolant to flow back along the wall to conduct heat through the wall away from the inner condenser surface 48. It will be noted that in (b) above, this feature permits one to increase the condensing surface area without increasing the return surface area. Such feature may be incorporated, for example, in the embodiments of FIG. 2, 5 and 6.

FIG. 5 is a schematic drawing of a turbine-type engine which incorporated features of the present invention. The turbine is claimed in said copending application Serial No. 53,898, the entire disclosure of which is incorporated herein by reference. In FIG. 5 the turbine rotor 50 on shaft 56 has a plurality of radially outwardly projecting turbine blades 51 which are hollow. A housing 52 encloses the rotor 50 and hot combustion gases blow into the housing via passages 54, past the blades 51, and out of the housing via outlet passages 55. The flow of hot combustion gases against the blades 51 imparts angular velocity or acceleration to the rotor 50 and, at the same time, heats the hollow blades 51. The rotor 50 is provided with a sealed partially liquid-filled cigar-shaped coaxial cavity 57 communicating with the hollow blade cavities 58 via small tubes 59. Heat in the liquid in the blade is transferred either by small vapor bubbles or very strong liquid natural convection current in the connecting tubes 59 to the interface in the central cavity 57.

Heat transferred from the vapor to the tapered concave condensing surface 62 of the rotor is conducted away from opposed convex outer surface 66 of the rotor by the flow of fuel or other coolant over that rotating surface 66 through a stationary jacket 63 which surrounds the exterior of the rotor 50 at the condenser end. Fuel enters the jacket 63 from the fuel tanks via inlet pipe 64 and leaves the jacket, preheated for combustion, on its way to the combustors via outlet pipe 65. The condensing surface 62 is curved in axial cross section to provide the desired pumping acceleration.

Figure 6:
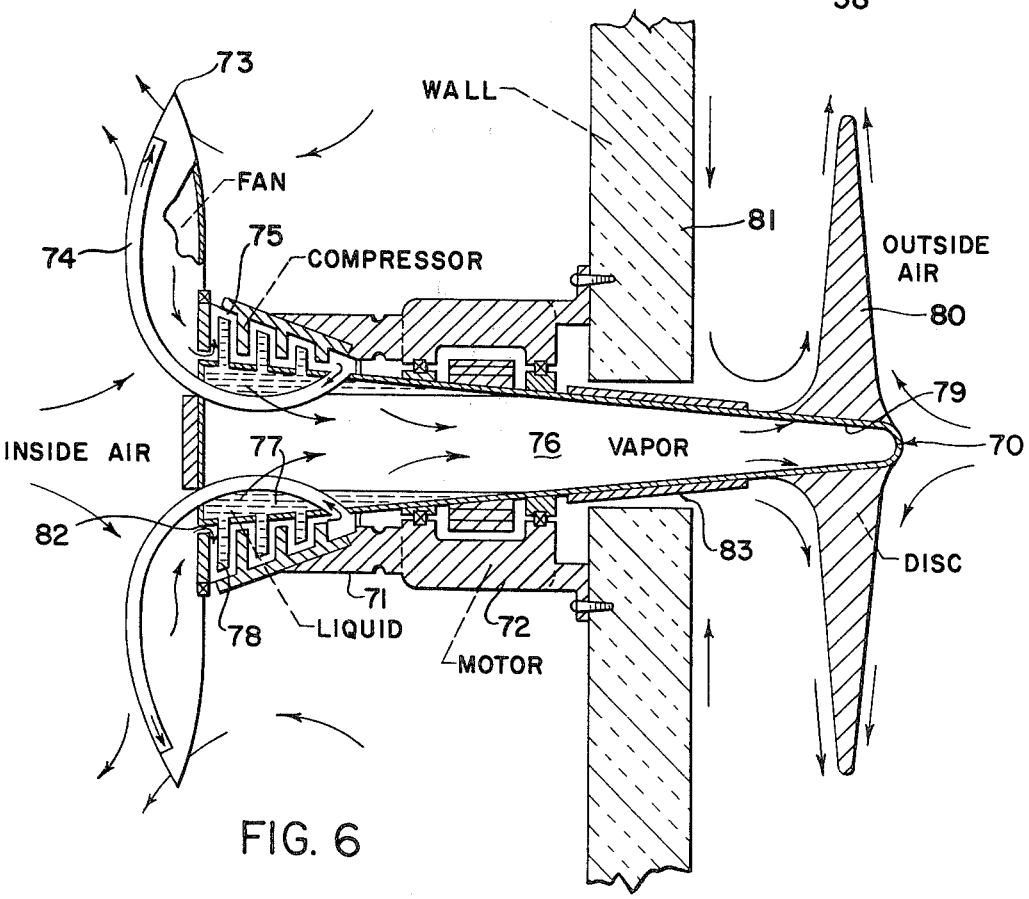
FIG. 6 is a longitudinal sectional schematic view of an air conditioning unit constructed according to the invention.

FIG. 6 is a schematic drawing of a novel air conditioning unit constructed according to my invention. This unit essentially comprises a rotor generally indicated by the numeral 70, and a housing generally indicated by the numeral 71. An electric motor 72 drives the rotor 70 in rotation in the housing 71, the motor's rotor windings wound on the rotor 70, and the motor's stator windings fixed in the housing 71. Hollow fan blades 73 are fixedly mounted at one end of the rotor 70 and partially filled with a conventional liquid refrigerant, such as freon. A hollow tube 74 communicates between each hollow blade tip and one end of the compressor passage 75 in the compressor. The other end of the compressor passage 75 communicates with each hollow blade cavity near the hub of the blade at compressor passage inlet 82. When the motor drives the rotor 70 in rotation, the refrigerant is compressed in the compressor passages 75 where it gives off heat of compression to liquid 77 in the evaporator region of heat pipe cavity 76. The compressed, liquefied refrigerant flows from the compressor into the tubes 74 toward the tips of the hollow blades 73 where, upon leaving the tubes 74 through orifices near the blade tips, it expands to fill the blades with cold vapor. Room air, induced to circulate past the exterior surfaces of the blades 73, gives off heat, cooling the room air and heating the cold vaporized refrigerant. The warmed vaporized refrigerant flows through the hollow blades 73 toward the axis where it re-enters the compressor at compressor passage inlet 82, where it is compressed, liquefied, and the cycle repeated.

When the compressed refrigerant gives off heat of compression to the liquid 77 in the evaporator end of the rotor cavity 76 (note the hollow interior surface 78 of the rotor compressor vanes forming a part of the total evaporator surface in the evaporator region), the vapor flows to the condenser end of the cavity 76, where it condenses on tapered surface 79 giving off heat to the outside air through the rotating tapered conductive disc 80 (constructed of aluminum or other good heat conductor). The surface 79 may be shaped so that the condensate is returned to the evaporator region under uniform centrifugal pumping acceleration according to the principles of the present invention discussed previously.

It will be noted that an insulating sleeve 83 is applied to the outer surface of the rotor 70 at the point where the rotor passes through the wall 81. This sleeve substantially prevents condensation on the conical interior rotor walls in that region so that heat is not given off into the inside air, but only into the outside air.

It will be apparent that relatively low temperature levels will be encountered at both ends of the rotor 70 (on exterior surfaces), and that the rotor liquid inventory must either have a relatively low boiling point at normal pressure, or the pressure in the rotor cavity must be relatively low.

The air conditioning unit shown in FIG. 6 has several advantages, including (a) that it can provide superior cooling in a compact unit; and (b) that it requires a very small hole in the wall (e.g., 3 or 4 inches) by comparison to conventional units which require large vents.

In addition, cooling can be further improved by providing a stationary shroud ring to collect condensation of room air moisture on the blades as it sprays off the blades, and this moisture can be ducted to the outside rotating disc 80 near its hub so that the moisture can be centrifuged radially outwardly over the rotating disc surfaces to help cool them.

As in the embodiment of FIG. 2, the electric motor 72 develops localized heat in the rotor windings and at the bearings upon which the rotor is journalled. In the construction of FIG. 6, the motor and the bearings at the evaporator region are effectively cooled by the heat pipe.

It will be appreciated that several of the devices illustrated herein, for example in FIGS. 2 and 4, show conical return walls that are not curved to produce uniform net pumping acceleration at all points along the walls. These illustrations were not intended to show optimum wall configuration for the devices shown, and it will be understood that properly curved return walls are preferred for all of the embodiments of FIGS. 1 through 6. The invention may be practiced less effectively with straight conical return walls.

Many different liquids are suitable for use in devices constructed according to the present invention. Preferred liquids for specific applications will be readily apparent to persons of ordinary skill in the art. For many applications, it will be preferable, or even essential, to utilize a liquid metal (such as liquid sodium, for example). One benefit of liquid metals is that they conduct heat readily (about 100 times faster than water) so that the condensate that forms on the condenser walls does not slow subsequent condensation while it is being pumped back to the evaporator region.

Similarly, the pipe may be constructed of many different materials as will be apparent to persons of ordinary skill, although it is usually preferably formed of a highly conductive, non-corrosive metal such as stainless steel, molybdenum, nickel, or their alloys. It is essential, however, that the pipe be constructed to withstand the substantial internal pressures that may be developed during operation.

As should be apparent to those skilled in the art, means of cooling the external surfaces of the condenser may be used other than those described herein such as water sprayed onto the rotating condenser with slinger rings mounted on the outside of the condenser, or wiping the condenser surface with liquid-saturated cloth type material.

It will be understood that, in accordance with the patent laws, further changes and modifications may be made without departing from the spirit of the invention as set forth in the claims appended hereto.

Having described my invention, I claim:

1. An air conditioning unit comprising a housing;

an elongated body mounted for rotation about its longitudinal axis in said housing, said body provided with an interior sealed elongated cavity coaxial with said longitudinal axis of said body and having a length at least several times its diameter, said cavity having a first portion locating at one end of said body, and said cavity having a second portion locating at the opposed end of said body, said second portion having generally conical walls with its larger diameter adjacent said first portion, said first portion having a diameter not less than the larger diameter of said second portion, every point on the conical walls defining said second cavity portion having a slope angle and radial distance from the axis which, when the body rotates at predetermined angular velocities, will produce a centrifugal pumping acceleration in excess of 1G in any condensate formed on said conical walls;

an inventory of a refrigerant liquid sealed in said cavity, said inventory sufficiently large to form a substantially uniform annulus when said body rotates at said predetermined angular velocities, said liquid inventory sufficiently small to be contained substantially within said first cavity portion when said annulus is formed;

means for driving said body in rotation at said predetermined angular velocities;

hollow fan blades mounted on the end of said body wherein said first cavity portion is located;

means for compressing a gaseous refrigerant at the exterior surface of said body wherein said first cavity portion is located and for condensing said refrigerant by transfer of heat from the refrigerant to the liquid in said first cavity portion, said compressing and condensing means provided with a fluid inlet and a fluid outlet, said fluid inlet communicating with the hollow interior or said fan blades in a region near the axis of rotation of said blades; and means for conveying said refrigerant from the fluid outlet of said compressing and condensing means into said hollow fan blades and for releasing liquefied gaseous refrigerant into a region near the radial tips of said blades.

2. An air conditioning unit according to claim 1 wherein said second portion projects through a relatively small opening in an external vertical wall and said heat pipe is supported from said wall for rotation about an axis generally perpendicular to said wall.

3. An air conditioning unit comprising a tapered hollow heat pipe with a length several times its diameter projecting through a relatively small opening in a vertical building wall, said pipe containing a sealed-in inventory of liquid including a reservoir in an evaporator region at the inside of said wall and a condenser region at the outside of the wall, drive means for rotating said heat pipe, heat transfer means for removing heat from the inside air, means for transferring heat from the heat pipe to the outside air to condense the vapors in said condenser region, and means for compressing a gaseous refrigerant at the outer surface of said heat pipe in said evaporator region and for condensing said refrigerant by transfer of heat from said refrigerant to the liquid in said evaporator region, means for causing flow of the refrigerant through said heat transfer means and said compressing and condensing means, whereupon the refrigerant is liquefied in said condensing means and is evaporated in said heat transfer means by conduction of heat from said inside air.

4. A process for operating an air conditioner having a housing mounted at an opening in a wall which separates a first body of air from a second body of air, a hollow hermetic member mounted for rotation about its central axis within said housing, means for compressing a gaseous refrigerant having a fluid inlet and a fluid outlet, and a hollow air impelling member mounted in said first body of air on said rotary member for rotation therewith, means connecting the interior cavity of said hollow impelling member with said compressor means to cause flow of said refrigerant through said cavity and said compressor means, and a vaporizable liquid located in said hollow rotary member, said hollow rotary member having a condenser region and an evaporator region, said evaporator region being located adjacent said compressor, said condenser region being located axially from said evaporator region in said second body of air, said hollow rotary member having an internal surface of substantially circular cross section with its center line coaxial with the axis of rotation of said rotary member and its interior condensing surface having a taper, said condensing surface gradually decreasing in diameter in an axial direction away from said evaporator region, and motor means for driving said rotary member in rotation, the steps of which comprise:

continually transferring heat from said first body of air to said refrigerant in said hollow air impelling member by rotating said impeller in said first body of air, whereupon heat therefrom is conducted by said impeller to said refrigerant which vaporizes and the resulting vapors flow to the inlet of said compressor means;

continually transferring heat from said gaseous refrigerant to said liquid in said hollow rotary member while compressing said refrigerant vapors in said compressor means and condensing the compressed refrigerant, whereupon said vapors are reliquefied and give off heat which is conducted by said hollow rotary member at said evaporator region to said liquid in said hollow rotary member which vaporizes and the resulting vapors flow axially into said condenser region;

continually transferring heat from said vapor in said hollow rotary member to said second body of air by condensing said vapor on the condensing surface of said hollow rotary member so that said vapor gives off heat which is conducted by said hollow rotary member through said condensing surface to said second body of air from the outer surface of said hollow rotary member opposite said condensing surface; and rapidly forcing the condensate off of said condensing surface as sonn as it forms to return said condensate to the evaporator region and to keep the condensing surface relatively free of liquid by rotating said condensing surface in excess of a predetermined rotary speed which provides a high centrifugal acceleration having a component equal to at least 1G in an axial direction parallel to the tapered condensing surface in the condensate located on said condensing surface, whereby the process provides a high rate flux from said first body of air to said second body of air.

5. Air conditioning apparatus comprising a housing adapted to be mounted at an opening in a wall which separates a first body of air from a second body of air;

a hollow hermetic member mounted for rotation within said housing, said hollow hermetic rotary member having a condenser region located in said second body of air and an evaporator region, said hollow hermetic rotary member having an internal surface of substantially circular cross section with its center line coaxial with the axis of rotation of said hollow hermetic rotary member, the interior surface of said hollow hermetic rotary member having a taper in said condenser region, the tapered condensing surface gradually decreasing in diameter in an axial direction away from said evaporator region;

a vaporizable liquid sealed in the interior cavity of said hollow rotary member;

means for compressing and condensing a gaseous refrigerant at the outer surface of said hollow hermetic rotary member in said evaporator region, said compressing means having a fluid inlet and a fluid outlet;

condensing means for liquefying said refrigerant by transfer of heat from the refrigerant to the liquid in said evaporator region; said condensing means having a fluid inlet and a fluid outlet; means connecting said condensing means inlet to said compressing means outlet;

a hollow air impeller mounted in said first body of air on said hollow hermetic rotary member for rotation therewith;

means connecting said compressing means inlet and said condensing means outlet to the interior cavity of said impeller to cause flow of said refrigerant through said interior cavity; and means for driving said hollow hermetic rotary member and said impeller together in rotation at a velocity such that the liquefied refrigerant collects in the radially outermost zones of the impeller cavity and absorbs heat from the impeller in such zones whereupon the refrigerant vaporizes and the resulting vapors flow through said compressor means and said condensing means, where they are reliquefied and give off heat, portions of such heat being conducted through said evaporator region of said hollow hermetic rotary member to said second liquid whereupon said second liquid vaporizes and the resulting vapors flow into said condenser region where they contact said tapered condensing surface and are returned to said evaporator region, said velocity being sufficient to generate a component of centrifugal acceleration in an axial direction parallel to said tapered condensing surface at essentially any location thereupon which is greater than 1G, the condensate formed on said condensing surface thereby being rapidly forced off of said condensing surface to keep it relatively free of liquid.

6. Air conditioning apparatus as recited in claim 5 wherein said driving means comprises stator windings mounted on the interior surface of said housing, and rotor windings mounted on the exterior of said hollow hermetic member adjacent said stator windings, radially outwardly of said evaporator region.

7. Air conditioning apparatus as recited in claim 5 wherein a heat conducting disc is mounted on the end of said hollow hermetic member radially outwardly of said condenser region.

8. Air conditioning apparatus as defined in claim 5 wherein said compressing means comprises a plurality of circumferentially spaced angled blades on the radially outer surface of said hollow hermetic rotary member in the evaporator region, said blades located in a compressor space between said hollow hermetic rotary member and the interior surface of said housing, said compressor space diminishing in cross-sectional area in a direction towards said condenser region, the inlet end of said compressor space communicating with the interior cavity of said hollow air impeller at a position located radially inwardly from the radially outermost portions of said impeller cavity, and wherein said apparatus further comprises a conduit communicating between the condensing means outlet and the hollow interior cavity of said impeller for delivering liquefied refrigerant to said interior cavity.

9. An air conditioning apparatus comprising an elongated rotary heat pipe projecting through an opening in a building wall, said pipe having a condenser region at the outside of the wall and containing a sealed-in inventory of liquid including a reservoir in an evaporator region at the inside of said wall, means for transferring heat from the rotary heat pipe to the outside air to condense the vapors in said condenser region, means for compressing a gaseous refrigerant at the outer surface of said heat pipe in the evaporator region and for condensing the refrigerant by transfer of heat from the refrigerant to the liquid in said reservoir, said compressing means having a fluid inlet and a fluid outlet, a hollow air impeller mounted in the inside air on said heat pipe for rotation in unison therewith, means connecting said inlet and said outlet to the interior cavity of said impeller to cause flow of said refrigerant through the interior cavity of said impeller, and means for driving said heat pipe and said impeller together in rotation.

* * * * *